US008919012B2

(12) United States Patent
Mueller et al.

(10) Patent No.: US 8,919,012 B2
(45) Date of Patent: Dec. 30, 2014

(54) FOOTWEAR AS MAT-SOCKS

(71) Applicant: Kybun AG, Roggwil (CH)

(72) Inventors: Karl Mueller, Roggwil (CH); Matthias Mueller, Roggwil (CH)

(73) Assignee: Kybun AG, Roggwil (CH)

( * ) Notice: Subject to any disclaimer, the term of this patent is extended or adjusted under 35 U.S.C. 154(b) by 223 days.

(21) Appl. No.: 13/721,520

(22) Filed: Dec. 20, 2012

(65) Prior Publication Data

US 2014/0000129 A1 Jan. 2, 2014

Related U.S. Application Data

(63) Continuation-in-part of application No. 11/991,507, filed as application No. PCT/IB2006/053634 on Oct. 1, 2006, now abandoned.

(30) Foreign Application Priority Data

| | | |
|---|---|---|
| Oct. 10, 2005 | (CH) | 1634/05 |
| Jan. 30, 2006 | (CH) | 153/06 |
| Sep. 26, 2006 | (CH) | 1531/06 |

(51) Int. Cl.

| | |
|---|---|
| ***A43B 1/02*** | (2006.01) |
| ***A43B 13/18*** | (2006.01) |
| ***A43B 13/12*** | (2006.01) |

(52) U.S. Cl.

CPC ..... *A43B 13/18* (2013.01); *A43B 13/125* (2013.01); *A43B 13/181* (2013.01); *A43B 13/187* (2013.01)

USPC ..... 36/9 R; 36/88; 36/71

(58) Field of Classification Search

USPC ..... 36/88, 93, 28, 15, 71, 100, 101, 9 R

See application file for complete search history.

(56) References Cited

U.S. PATENT DOCUMENTS

| | | | |
|---|---|---|---|
| 580,501 | A | 4/1897 | Mobberley |
| 2,142,981 | A | 1/1939 | Richards |
| 2,149,102 | A | 2/1939 | Quennard |
| 2,205,091 | A | 6/1940 | Geffner |
| 2,430,338 | A | 11/1947 | Heiman |
| 2,495,984 | A | 1/1950 | Roy |
| 2,820,308 | A | 1/1958 | Hiestand |
| 3,063,074 | A | 11/1962 | Scholl |
| 3,120,711 | A | 2/1964 | Scholl |

(Continued)

FOREIGN PATENT DOCUMENTS

| | | |
|---|---|---|
| DE | 29920480 | 2/2000 |
| EP | 0999764 | 5/2003 |

(Continued)

*Primary Examiner* — Marie Bays

(74) *Attorney, Agent, or Firm* — Shoemaker and Mattare

(57) ABSTRACT

The present invention relates to functional footwear of a new concept, which adapts itself to the shape of a foot and gives a soft feeling when walking The footwear includes: an upper foot fixing section (1) for covering and fixing an upper portion of a foot; and a foot supporting section (8) attached to the upper foot fixing section for supporting a lower portion of the foot. The foot supporting section comprises a soft resilient mat (2) which can be deformed according to the shape of the foot. The footwear has a simple structure and can give a feeling of walking barefoot on a sponge mat or on a lawn like a extreme-soft-elastic carpet to provide complete comfort to the wearer during walking.

10 Claims, 6 Drawing Sheets

(56) References Cited

U.S. PATENT DOCUMENTS

| | | | | |
|---|---|---|---|---|
| 3,721,024 | A | 3/1973 | Innerbickler | |
| 3,730,169 | A | 5/1973 | Fiber | |
| 3,766,669 | A | 10/1973 | Pearsall | |
| 4,008,530 | A | 2/1977 | Gager | |
| 4,103,440 | A | 8/1978 | Lawrence | |
| 4,627,179 | A | 12/1986 | McElroy | |
| 4,779,359 | A | 10/1988 | Famolare, Jr. | |
| 4,813,162 | A | 3/1989 | Harris | |
| 4,914,837 | A | 4/1990 | Rieffel | |
| 4,926,568 | A | 5/1990 | Coffman | |
| 4,981,010 | A | 1/1991 | Orza et al. | |
| 5,199,191 | A | 4/1993 | Moumdjian | |
| 5,253,434 | A | 10/1993 | Curley et al. | |
| 5,423,134 | A | 6/1995 | Bagnaia et al. | |
| 5,553,399 | A | 9/1996 | Strong | |
| 5,718,064 | A | 2/1998 | Pyle | |
| 5,727,334 | A | 3/1998 | Cougar | |
| 5,926,888 | A | 7/1999 | Chen et al. | |
| 5,996,253 | A | 12/1999 | Spector | |
| 6,061,928 | A | 5/2000 | Nichols | |
| 6,134,741 | A | 10/2000 | Spalione | |
| 6,199,304 | B1 | 3/2001 | Ludemann | |
| 6,425,195 | B1 | 7/2002 | Donzis | |
| 6,484,419 | B1 | 11/2002 | Rohde et al. | |
| 6,532,689 | B1 | 3/2003 | Jones, Jr. | |
| 6,584,706 | B1 | 7/2003 | Ellis, III | |
| 6,775,927 | B2 | 8/2004 | Glicksman | |
| 6,782,640 | B2 | 8/2004 | Westin | |
| 6,823,611 | B2 | 11/2004 | Otis et al. | |
| 6,931,767 | B2 * | 8/2005 | Royle | 36/111 |
| 7,010,872 | B2 | 3/2006 | Pawlus et al. | |
| 7,059,067 | B2 | 6/2006 | Geer et al. | |
| 7,941,938 | B2 * | 5/2011 | Yu et al. | 36/25 R |
| 2004/0010938 | A1 * | 1/2004 | Li-Wang et al. | 36/9 R |
| 2005/0288442 | A1 * | 12/2005 | Chou et al. | 525/199 |
| 2008/0005934 | A1 | 1/2008 | Fernandez | |
| 2008/0256828 | A1 * | 10/2008 | Doran | 36/88 |
| 2008/0302371 | A1 | 12/2008 | Cohen et al. | |
| 2009/0013558 | A1 | 1/2009 | Hazenberg et al. | |
| 2009/0107007 | A1 | 4/2009 | Keating | |
| 2009/0172970 | A1 * | 7/2009 | Prieto et al. | 36/71 |
| 2009/0235433 | A1 | 9/2009 | Harris et al. | |

FOREIGN PATENT DOCUMENTS

| | | |
|---|---|---|
| EP | 1124462 | 10/2004 |
| WO | 99/29203 | 6/1999 |
| WO | 00/78171 | 12/2000 |
| WO | 2004/028285 | 4/2004 |

* cited by examiner

FOOTWEAR AS MAT-SOCKS

This application is a continuation-in-part of copending application Ser. No. 11/991507, filed Mar. 4, 2008, which was the U.S. national stage of international application PCT/IB2006/053634 filed Oct. 4, 2006, which claimed priority under 35 USC 119 from Swiss patent applications No. 01634/05, filed Oct. 10, 2005, No. 00153/06 filed Jan. 30, 2006 and No. 01531/06 filed Sep. 26, 2006.

BACKGROUND OF THE INVENTION

1. Field of the Invention

The present invention relates to functional footwear of a new concept, which adapts itself to the shape of a foot and gives a soft feeling when walking.

2. Description of the Prior Art

Examples of general footwear are shoes and socks.

The structure of a general shoe has been variously developed according to the usage thereof. The general shoe includes an upper part, covering the top portion of a foot and maintaining the appearance and shape of the shoe, and a sole. In the sole, an outsole making contact with the ground, a midsole positioned between the outsole and a lasting board, a lasting board formed of a hard material for maintaining the appearance of the shoe and functioning as a connection portion between the upper part and the sole, and an insole for hiding waste threads, tacks, and nails are sequentially stacked.

Here and afterwards the word lasting board shall be understood to be the part of a standard shoe defining its shape and stability of the shoe. The lasting board normally is situated between the insole and the midsole. The lasting board further serves as a connection part between the upper part of the shoe and its sole.

Further, a general sock, especially an ankle sock, includes an upper portion covering a top portion of a foot and a bottom portion surrounding the bottom of the foot.

In relation to the feeling when walking, a shoe for absorbing an impact due to the weight of a wearer during walking or exercise, by inserting an elastic body into the portion between the lasting board and the outsole or forming a midsole out of an elastic material, has been suggested. However, in the structure of the conventional shoe, since the lasting board cannot be made of a soft and elastic material but can be made only of a hard material in order to function as a connecting portion of the upper and the sole, to maintain the shape of the shoe, and to fix the midsole or the elastic body inserted into the midsole, there has been a limit in obtaining a sufficiently soft touch in the aspect of the feeling when walking with which the shoe adapts itself to the shape of the foot.

In the conventional shoe, the problem of the hard lasting board has been supplemented by generally using an insole. However, even in this case, since the shoe has a hard lasting board at a lower portion of the insole, there also has been a limit in obtaining a sufficiently soft touch in the aspect of the feeling when walking.

In the case of an ankle sock, there has been an effort to lessen the partial impact and to improve the wearing feeling by using double woven fabrics at the bottom portion thereof. However, since the ankle sock assumes the wearing function of a shoe, there still has been a limit in obtaining a sufficiently soft touch in the aspect of the feeling when walking with which the sock adapts itself to the shape of the foot.

In the case of a functional shoe used for orthopaedic objects such as form correction, improvement or prevention of muscular skeleton problems, and assistance of rehabilitation, and for exercises of predetermined portions such as reinforcement of predetermined muscles, the objects are generally accomplished by an insole of a shoe.

Further, European Patent Nos. 0999764 and 1124462 disclose functional shoes for the orthopaedic objects and for exercises of predetermined portions of the human body.

In the patents, a shape including a hard-soft-transition portion is defined between the foot and the ground surface. As a result, a rolling process is compulsorily performed, reliant upon the desired type during walking or additional load is applied to a predetermined muscle(s) when walking such that the shoe corresponds to a predetermined object(s) necessary for a wearer of a shoe.

Further, the above-mentioned shoe has the object of simulating the feeling of walking, for example, on non-flat surfaces such as a sandy plain, forest soil, or a pasture, while being used on a flat surface such as an asphalt road, a concrete, or a plate bottom.

However, since the above-mentioned functional shoe includes a hard lasting board or a separate hard structure for maintaining the appearance of the shoe, there has been a limit in obtaining a sufficiently soft touch in the aspect of the feeling when walking with which the shoe adapts itself to the shape of the foot.

Further, since the functional shoe works as a compulsory therapy demanding a predetermined walking method and a predetermined posture to a wearer, the wearer should maintain the balance using the required locomotive organs such as muscles and skeletons. The walking method or the regulation of the walking posture is determined by the use of a hard or soft insertion material having a bottom structure of a predetermined shape. An orthopaedist deliberately determines how the wearer should act and which attitude the wearer should take and accordingly the predetermined shape of the bottom structure is determined.

However, the predetermined shape of the bottom structure can be unsuitable for individual symptoms and have a danger of demanding wrong posture over a long period of time due to an unsuitable diagnosis of an orthopaedist.

In the conventional shoes used for functions, it is often necessary for the shoes to adapt themselves to the individual walking methods and the individual structures of locomotive organs in order to have an excellent effect for the orthopaedic objects or the exercises for predetermined portions. However, in general, as well as if a wearer selects a wrong structure or an orthopaedist makes an inaccurate diagnosis, the functional shoes are not comfortable when the shoes are initially worn, are difficult to wear, and can cause a complete inconvenience at the worst. Such a situation arises when wearers need to adapt themselves to the shoes.

Not only do the wearers adjust themselves to the shoe but also the shoe adapt itself to the shape of the wearer's foot and the walking methods of the wearers in the shoes and the lasting boards, which are manufactured of leather or cloth by a simple method.

However, fiber, plastic, and rubber, currently used as synthetic materials, have a basic limit in adapting the soft materials to the foot of the wearer due to their characteristics and the structures of the above-mentioned shoes.

Further, it has been studied and proved experimentally that giving comfortableness to the feet of a wearer and allowing the maximum degree of freedom has an orthopaedic healing effect by the motion sequence of the wearer. This has a thread of connection with a report stating that people from the countryside that walk barefoot on soft natural ground maintain locomotive organs far fitter than city dwellers wearing standardized shoes.

Therefore, it is necessary to develop a footwear of a new concept which adapts itself to the wearer to provide complete comfortableness during walking and allows the maximum degree of freedom to a foot even if some or all of the structures for maintaining the appearance of the footwear are abandoned.

SUMMARY OF THE INVENTION

Accordingly, the present invention has been made to solve the above-mentioned problems occurring in the prior art, and an object of the present invention is to provide footwear which has a simple structure and can give a feeling of walking barefoot on a sponge mat or on a lawn like a extreme-soft-elastic carpet to provide complete comfortableness to the wearer during walking.

It is another object of the present invention to provide footwear that can easily change the wearing feeling and the correction function during walking if necessary.

It is still another object of the present invention to provide footwear that gives complete comfortableness to the wearer during walking and allows the maximum degree of freedom to the foot.

In order to achieve the above-mentioned objects, there is provided footwear comprising an upper foot fixing section for covering and fixing the upper portion of a foot, and a foot supporting section attached to the upper foot fixing section for supporting the lower portion of the foot. The foot supporting section comprises a soft resilient mat which can be deformed according to the shape of the foot. The foot supporting section further comprises a shroud covering at least a portion of the outer surface of the resilient mat. The shroud is an integrally formed part of the resilient mat either created by the process of foaming and/or attached to the resilient mat. The shroud is formed preferably uniformly of a latex material or of a polyurethane compound, a rubber compound or a silicone compound. The shroud can be separately manufactured or built directly by introducing the material of the resilient mat into a mold. The upper end of the shroud is attached by bonding, gluing, fusing, riveting or sewing to the lower end of the foot fixing section. The shroud comprises a bottom portion integrally formed with a peripheral portion of the shroud. The foot supporting section comprises a sole being integrally formed with the bottom portion of the shroud or being attached to the bottom portion of the shroud. The resilient mat comprises foamed plastic material with a rebound resilience of more than 30%. Preferably the rebound resilience is more than 34%, more preferably more than 38%. The foamed plastic material of the resilient mat has a compression stress value in relation to a compression rate as given in the table below:

| compression | compression stress value [kPa] | | |
|---|---|---|---|
| [%] | nominal | preferably | most preferably |
| 20 | 36-54 | 41-50 | 43-47 |
| 40 | 66-100 | 75-91 | 79-87 |
| 60 | 116-174 | 131-160 | 138-152 |
| 70 | 183-275 | 206-252 | 218-240 |
| 80 | 382-574 | 430-526 | 454-502 |

The rebound resilience of the foamed plastic material of the resilient mat can be measured as follows: A test sample of a thickness of 30 mm and a square size of at least 70 mm×70 mm has to be prepared and placed on a hard rigid surface. The test sample preferably shall be cut from the foamed plastic material of the resilient mat from the heel area of the sole. A spherical ball with a hard surface having a diameter of 28 mm and a weight of 110 g need to be dropped from different heights of 40 cm, 60 cm and 94 cm onto the test sample. The test sample shall be placed such that the ball meets the sample in its central point. The height of the rebound of the ball is measured. The rebound resilience then is the ratio between the height of the rebound and the drop height expressed in percentage. The drop height as well as the height of rebound is to be measured as the distance between the surface of the test sample and the lowest point of the ball at its climax for the rebound height. The arithmetic average of multiple measurements of at least three test samples and of the three different heights as given above shall be taken. In order to verify the test results, the same test can be repeated using a different spherical ball having a diameter of 19 mm and weight of 32 g. The deviation of the test results using the different ball size shall be within 5%. A high percentage of rebound resilience results in a comfortable and soft feeling when walking Especially when the foot has to be lifted for taking another step, a trampoline like feeling makes walking comfortable and energy saving.

The compression stress value basically is measured according to ISO 3386-1 with slight adaptations as described below and different compressions applied to the material. The different compressions are given in the table above. The test sample again shall have a thickness of 30 mm and a square size of 70 mm×70 mm at least. Preferably the test sample is cut from the foamed plastic material of the resilient mat from the heel area of the sole. Other than specified in ISO 3386-1, the plunger to apply the compression to the test sample shall have no flat surface abutting the test sample but shall have a curved surface having a radius of 50 mm. The horizontal diameter of the plunger shall be 29.5 mm. Such a plunger is used to simulate the heel of a person wearing the shoe. The defined compressions are applied to the test sample in an increasing manner using steps of 5%. The corresponding force is measured immediately when the specified compression is reached. However, after each measurement, the test sample is allowed to settle into the set compression for one minute before the next compression value is to be applied. The compression value for each compression then is calculated according to the formula given in ISO 3386-1 using the surface area of the plunger as the surface. Materials being harder are no longer comfortable and do not result in the desired training effect. A material being softer is no longer suitable to be used for standing since the material can easily be compressed to the ground.

The foamed plastic material of the resilient mat can be a foamed polyurethane compound, a rubber compound or a silicone compound. Polyurethane has excellent physical characteristics and is especially resistant against abrasion. Rubber and silicone exhibit similar characteristics.

The foamed plastic material of the resilient mat can have an apparent density of between 200 kg/m$^3$ and 360 kg/m$^3$, in particular between 240 kg/m$^3$ and 320 kg/m$^3$, preferably between 260 kg/m$^3$ and 280 kg/m$^3$. The apparent density thereby is measured according to ISO 845.

The foamed plastic material of the resilient can have a tear strength of at least 0.9 N/mm, in particular at least 1.0 N/mm, preferably at least 1.05 N/mm. The foamed plastic material of the resilient mat can have a tensile strength of at least 700 kPa, in particular at least 800 kPa, preferably at least 900 kPa. The foamed plastic material of the resilient mat can have an elongation at break of at least 126%, in particular at least 150%, preferably at least 175%. The tensile strength and the elongation at break shall be measured in accordance to DIN 53504 while tear strength shall be measured according to DIN 53507. Test samples shall be cut from the foamed plastic material of the resilient mat of the sole, starting from the heel area. Preferably there are no voids in the test sample other than the pores of the foam.

A conventional shoe essentially includes a hard lasting board or a hard structure for maintaining the appearance thereof. The footwear according to the present invention might not comprise a lasting board or a separate structure for maintaining the appearance of a shoe. Such a construction will allow feeling directly the softness of the resilient mat of the foot supporting section of the footwear.

The resilient mat might have holes perpendicular to its top surface in order to achieve a good ventilation of the foot during walking when the footwear is word. The holes might go completely through the resilient mat or might be blind holes being only open to the top surface of the resilient mat.

In accordance with the present invention, in spite of partially abandoning the aspect of maintaining the appearance of a shoe, the present invention not only has a relatively simple structure and can give a feeling of walking barefoot on a sponge mat or on a lawn like a extreme-soft-elastic carpet to provide complete comfortableness to the wearer during walking but also can give the maximum degree of freedom to a foot by adapting a contact portion with the foot to the shape of the bottom of the foot.

Preferably, the foot supporting section further includes a shroud covering a portion or all portions of the outer surface of the soft resilient mat and fixing the soft resilient mat.

According to the structure, the resilient mat can be protected and easily received and fixed and the resilient mat (the resilient mat received in a chamber in the case in which the shroud forms the chamber) can be exchanged, with the appearance of the footwear having the upper foot fixing section and a shroud maintaining the original shape.

Preferably, the foot supporting section includes a bottom portion formed on the outer surface of the shroud for preventing slide movement of the footwear when the footwear makes contact with the ground. The bottom portion is integrally formed with the shroud and might be thicker than the other portions. A separate sole might be formed and attached, preferably by bonding, to the bottom portion of the shroud. Also, the sole can be formed by coating at least a portion of the bottom portion of the shroud.

Preferably, a portion for inserting and withdrawing the resilient mat is formed on the surface of the shroud.

According to the structure, only the resilient mat can be easily inserted and withdrawn without separating the foot supporting section from the upper foot fixing section.

More preferably, the shroud is detachably attached to the foot fixing section so that the foot supporting section can be attached to the foot fixing section.

According to the structure, the foot supporting section can be attached to the foot fixing section in various methods without any restriction in the type and shape of the resilient mat only by partially deforming the shroud and the upper foot fixing section to provide an engagement portion, and the foot supporting section can be attached and detached, and the soft resilient mat inside the shroud can be exchanged if necessary. The attachment of the shroud to the resilient mat is not limited to above mentioned detachable attachment to the foot fixing section, and the shroud can be integrally formed with the resilient mat or can be separately formed and firmly attached to the resilient mat by bonding, etc.

Further, as mentioned above, the shroud can have a portion which can be opened and closed and can be used for inserting and withdrawing the resilient mat to exchange the resilient mat without separating the entire shroud from the upper foot fixing section.

Preferably, the shroud includes at least one chamber for receiving the resilient mat.

Accordingly, by receiving the resilient mat into the chambers and the resilient mat might comprise areas having various elastic properties; the resilient mat can provide the feeling when walking suitable for the requirements of the wearer and can be exchanged to easily change the elastic properties according to the foot contact portions.

Preferably, the resilient mat is divided into a plurality of divisions each of which includes a elastic body.

According to the structure, the wearing feeling and the correction function during walking can be modified to meet the requirements of the wearer by regulating the shape and/or material of the divisions.

Further, the resilient mat uses an opened elastic body, a closed elastic body, or both of them.

Here, the opened elastic body refers to a elastic body for example, a foam material or structure made of a sponge, rubber or a natural/synthetic resin which contains air inside itself or its structure, having a property of elasticity in the method of discharging air by applying a pressure and pressing the elastic body and recharging air by decreasing the pressure.

In the case of forming a resilient mat including the opened elastic body, if the elastic body is compressed, the air existing in a middle space of the material or structure can be transferred into the interior of the upper foot fixing section, the foot of the wearer reaches a ventilation state due to the air-flow generated during pressing and expansion of the air as well as get a soft feeling when walking due to the elastic body.

The closed elastic body refers to a elastic body for example, a filled body having the shape of a closed bag which is filled with a filling material such as air, a fluid, and a gel or a rubber with a property of elasticity of which only the shape can be changed by applying a pressure while the air or filling material is not introduced or discharged. The bag-shaped filling body is provided with a valve (not shown) so that the property of elasticity can be varied, if necessary, by discharging or refilling the filling material inside thereof.

Preferably, the resilient mat is divided into an upper portion including at least one opened elastic body and a lower portion including a closed elastic body.

By the dual structure of the resilient mat, the lower portion provides a property of elasticity relatively stable, and the upper portion uses the opened elastic body so that the ventilation property of the footwear can be improved during the time of walking by using the air generated while the resilient mat is loosened and contracted.

The resilient mat might include hard elastic particles inside.

According to the structure, the elastic particles inside of the resilient mat can function as a buffer which alleviates the phenomenon that the soft resilient mat is rapidly pressed when the footwear is worn and prevents the feeling of the hard ground from being transferred to the foot when the resilient mat is compressed most. Further, the feeling of wearing the footwear or the feeling when walking can be regulated by regulating the number, size, and type of the hard elastic particles inserted when the resilient mat is manufactured, thereby regulating the compression degree and the maximum compression thickness.

Preferably, the present invention includes a sole attached to the outer surface of the foot supporting section in order to protect the foot supporting section including the resilient mat and to prevent slide movement while making contact with the ground.

The sole can be formed directly in the bottom portion of the shroud but is not limited thereto. The shroud can extend and cover at least one of the front, rear, right, and left sides of the foot in order to engage the foot supporting section with the upper foot fixing section additionally or extends in order to fix a portion or all of the foot additionally.

Further, the upper foot fixing section is formed of a soft material and has the shape of a sock. The soft material includes a natural or synthetic fiber as in a general sock and any material flexible enough to attach or detach the footwear such as natural or synthetic latex and a synthetic resin.

Since the upper foot fixing section has the shape of a general sock, it can be easily attached or detached and can maximize the wearing feeling and the soft feeling when walking as compared with a conventional shoe.

Preferably, the upper foot fixing section has the shape of a sock of a textile material and is attached to the shroud at the upper end portion of the foot to be integrally formed with the shroud. In this case, the shroud can be attached by various methods such as sewing, bonding, etc. Especially in case that the material of the shroud is the same one of the upper foot fixing section, the shroud can be integrally formed with the upper foot fixing section by weaving or can be separately manufactured and then attached to the upper foot fixing section by sewing etc. so as to have the shape of a dual sock having a reception space at the lower end thereof.

More preferably, a portion of the engagement portion of the upper foot fixing section and the shroud can be opened and closed to withdraw and exchange the resilient mat. Further, the shape of the upper foot fixing section is not limited to that of a sock and can be applied to various shapes of shoes, sandals, etc.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
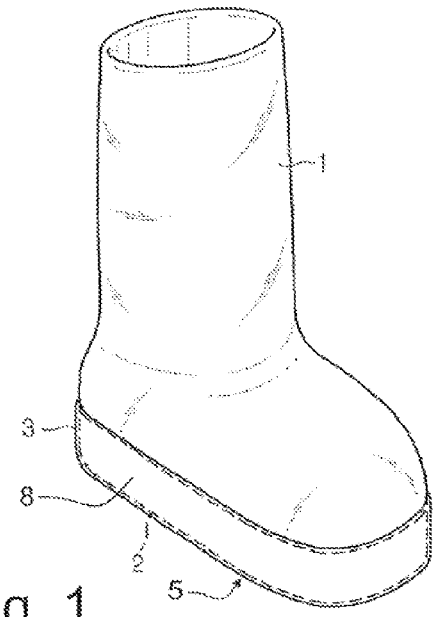
FIG. 1 is a perspective view showing the first preferred embodiment of footwear of the present invention.

Hereinafter, preferred embodiments of the present invention will be described in detail with reference to the accompanying drawings. For reference, the same elements are indicated by the same reference numerals in the drawings.

FIG. 1 is a view showing a preferred embodiment of footwear according to the present invention. Basically, the footwear of the present invention includes an upper foot fixing section 1 for covering and fixing an upper portion of a foot and a foot supporting section 8 attached to the upper foot fixing section 1 for supporting the lower portion of the foot. In the preferred embodiment of the present invention, the foot supporting section 8 comprises a soft resilient mat 2 which can be deformed according to the shape of the bottom of the foot, a shroud 3 integrally formed with the resilient mat 2 or separately attached to the resilient mat 2 for fixing the resilient mat 2, and a sole 4 (see FIG. 3*f*) formed on the bottom portion 5 of the shroud 3 or attached to it for preventing slide movement of the footwear.

As can be understood in the preferred embodiment, since the present invention does not include a hard lasting board and a separate part to maintain the appearance of the footwear, different from a general shoe, the feel of the soft resilient mat 2 is transferred to the foot as it is during the time of walking, and thus the wearer feels the comfortableness of walking barefoot on a soft sponge, a carpet, or a lawn.

Further, the sole 4 (see FIG. 3*f*) formed on the bottom portion 5 of the shroud 3 for preventing the slide movement of the footwear can be selectively formed. The sole 4 or even the shroud 3 can be omitted if unnecessary according to the material and shape of the resilient mat 2 or the place in which the footwear is used. In case that the sole 4 is omitted, the resilient mat 2 alone forms the foot supporting section 8. Further, in the case that the shroud 3 is applied to the footwear according to the present invention, the sole 4 can be integrally formed with the shroud 3 when the shroud 3 is formed or can be separately attached to the ground bottom portion 5 of the shroud 3.

In addition, as described later, the shroud 3 can extend upward to fix the foot supporting section 8 to the upper foot fixing section 1.

In the preferred embodiment of the present invention, the soft resilient mat 2 can be fixed to the upper foot fixing section 1 by one of the well-known engaging methods such as bonding with an adhesive, sewing, and engagement with a Velcro fastener, a slide fastener (or a zipper), or a snap fastener. In the case in which the shroud 3 is applied to the resilient mat 2, the shroud 3 including the resilient mat 2 can be attached to the upper foot fixing section 1 using an engagement portion of the shroud 3 according to the well-known methods.

The upper foot fixing section 1 is comprised of a soft material and can have various shapes such as a sock, a rubber boot, a sports shoe, a sandal, a slipper, and the like according to its use. The material of the upper foot fixing section 1 can include various materials such as a soft rubber, a textile, a net, leather, and the like.

Further, a plurality of ventilation holes can be formed in the upper foot fixing section 1 and the design of the foot fixing section 1 can be modified, for example, by forming a transparent window.

The resilient mat 2 comprises a soft elastic material. The material of the resilient mat 2 can be classified into an opened elastic body and a closed elastic body, the opened elastic body refers to a resilient mat 2 for example, a foam material or structure made of a sponge, or a natural/synthetic resin which contains air inside itself or its structure, having a property of elasticity in the method of discharging air by applying a pressure and pressing the resilient mat 2 and recharging air by decreasing the pressure, the closed elastic body refers to a resilient mat 2 for example, a filled body having the shape of a closed bag which is filled with a filling material such as air, a fluid, and a gel or a rubber with a property of elasticity of which only the shape can be changed by applying a pressure and compressing the resilient mat 2 while the air or filling material is not introduced or discharged. For the various embodiments of the resilient mat 2 one or both type can be used.

The material and the structure of the resilient mat 2 are selected so that the compression rate of the resilient mat 2 is fifty to ninety percent if the footwear is worn by a standard person. A standard person shall be understood as a male person of 85 kg wearing shoe size US 9. The compression then is measured when standing still on one foot.

The planer shape of the resilient mat 2 generally follows that of the bottom surface of the footwear. When the footwear is worn, the thickness d2 of the resilient mat 2 varies according to the weight of the wearer, the property of elasticity of the resilient mat 2 and the original thickness d1 when the resilient mat is not compressed (see FIGS. 6*a* and 6*b*). Further, as described above, the resilient mat 2 of the present invention has a compression rate of fifty to ninety percent when the footwear is worn by a standard person as defined above. Therefore, according to the present invention, it is preferable that the thickness d1 of the resilient mat 2 is at least 1 cm when the resilient mat 2 is not compressed. However, the thickness d1 might be smaller, e.g. 0.5 cm if the footwear is designed for children.

The shroud 3 is formed of the same material as the upper foot fixing section 1 or of a different material from the upper foot fixing section 1. The shroud 3 can be formed of a soft elastic material and various materials such as a synthetic or natural textile material, synthetic or natural latex, polyurethane, and the like can be used.

Figure 2A:
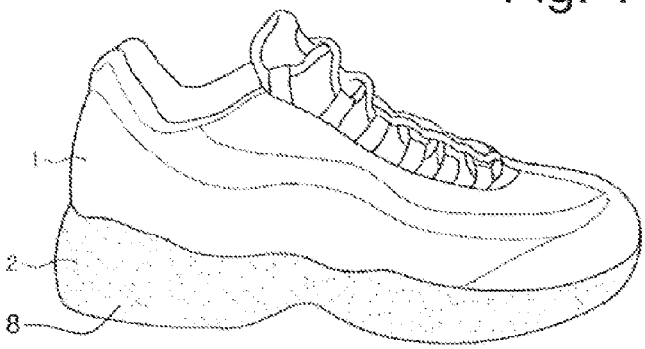
FIGS. 2*a* and 2*b* are perspective views showing other preferred embodiments of a footwear of the present invention.
Figure 2B:
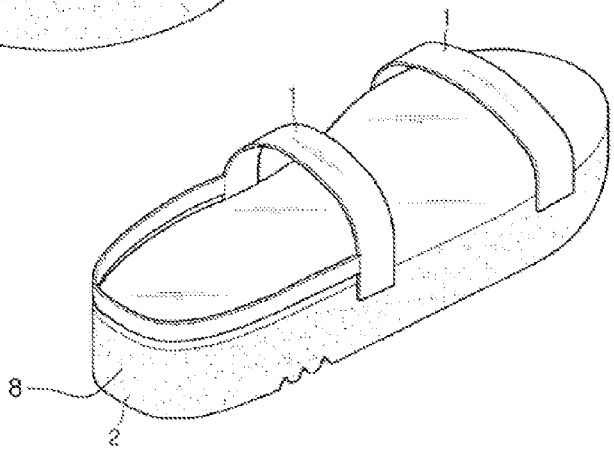

FIGS. 2*a* and 2*b* are perspective views showing a constitution of other preferred embodiments of the present invention.

Since the basic technical spirit is the same as the preferred embodiment of FIG. 1, the reiterated description will be omitted. The foot supporting section 8 comprises the resilient mat 2 only, no shroud is applied.

The footwear of the embodiment of FIG. 2*a* has the shape of a general shoe or a sports shoe, while the footwear according to FIG. 2*b* has the shape of a sandal. A resilient mat 2 forming a foot supporting section 8 has the shape of a sole of a general shoe or a sport shoe in the state in which a pressure is not applied before the footwear is worn. Further, since the compression rate of the footwear becomes fifty to ninety percent if the footwear is worn by a standard person as defined above and pressed, the shape of the footwear, especially the shape of the foot supporting section 8 and the resilient mat 2 is deformed.

The material of the upper foot fixing section 1 includes various soft materials such as a soft rubber, a textile, a net, leather, and the like.

In case that a shroud 3 is applied to the footwear, the resilient mat 2 is firmly attached to the inner surface of the shroud 3. The upper foot fixing section 1 having the shape of a general shoe, a sports shoe or a sandal and the resilient mat 2 forming the foot supporting section can be exchanged if necessary and can be detachably attached to one another.

FIGS. 3*a* to 3*h* are views for explaining formation methods of foot supporting sections according to the structures of the resilient mat 2, the shroud 3, and the sole 4 of the present invention.

Figure 3A:
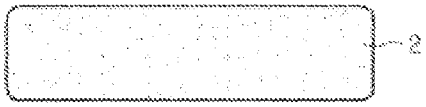
FIGS. 3*a* to 3*h* are views for explaining methods to form a foot supporting section according to the structures and formation methods of a resilient mat, a shroud, and a sole of the present invention.

FIG. 3*a* shows an embodiment of a foot supporting section including only the resilient mat 2. The resilient mat 2, which is a elastic body, may have a portion for functioning as a shroud integrally formed on the outer surface thereof during the manufacturing process. In this case, depending on manufacturing method for use, the shroud or the portion functioning as the shroud can be formed of the same material as the elastic body, thereby strengthening the mechanical friction of the outer surface of the resilient mat 2. The resilient mat 2 can be directly attached to the upper foot fixing section 1 (see FIGS. 2*a* and 2*b*) or can be used as an inserted material according to the form of the embodiment. Further, a sole 4 (see FIGS. 3*f* to 3*g*) preventing slide movement of the footwear can be selectively formed on the bottom portion 5 of the shroud 3 or can be formed on the lower side of the resilient mat 2 (see FIG. 3*e*).

In the case in which the shroud 3 described later is applied, the shroud 3 can be integrally formed with the resilient mat 2 when the resilient mat 2 is manufactured. In the case in which the shroud 3 is separately manufactured, it can be detachably attached to the resilient mat 2 as well as firmly attached to the resilient mat 2 by bonding etc.

Figure 3E:
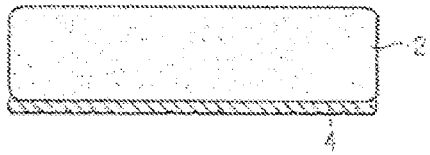
Figure 3B:
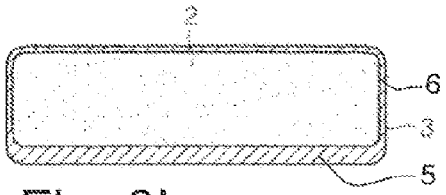

FIG. 3*b* shows a preferred embodiment in which the shroud 3 covers the entire resilient mat 2. In this case, for example, the shroud 3 should be an essentially soft elastic membrane or film such as a thin rubber, polyurethane, resilient textile, etc. In the preferred embodiment, the bottom portion 5 of the shroud 3 itself functions as a sole by making contact to the ground. This bottom portion 5 can be made thicker than the other portions, especially thicker than the peripheral portion 6, when the shroud 3 is manufactured.

Figure 3F:
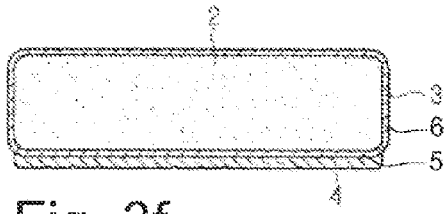
Figure 3C:
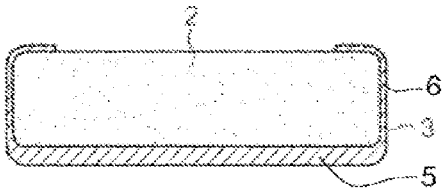

FIG. 3*c* shows the case in which the shroud 3 covers only the periphery of the upper surface of the resilient mat 2 to minimize the change of the wearing feeling of the footwear. Similarly, the bottom portion 5 is made thicker than the peripheral portions 6 when the shroud 3 is manufactured.

The portion of the shroud 3 which covers the resilient mat 2, functions as an engagement portion when the upper foot fixing section 1 is attached to the shroud 3 by bonding, sewing, or Velcro, etc.

Figure 3G:
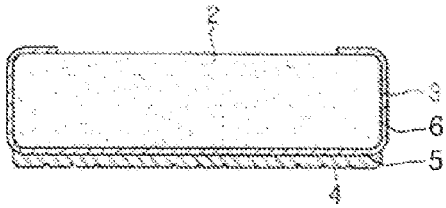
Figure 3D:
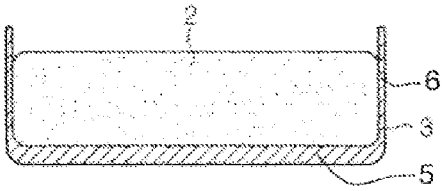

Referring to FIG. 3*d*, the shroud 3 extends to the upper side of the resilient mat 2. An engagement portion which can be equipped with a slide fastener, a Velcro fastener or a snap fastener, serves to attach the foot supporting section 8 to the corresponding portion of the upper foot fixing section 1. The shroud 3 can extend further to reach the upper foot fixing section 1 in the form of an overshoe or a dual sock. Likewise, the bottom portion 5 of the shroud 3 is made thicker than the peripherals portions 6 when the shroud is manufactured. Also the shroud 3 can be bonded directly or attached differently to the upper foot fixing section 1.

FIG. 3*e* shows an embodiment of a foot supporting section similar to FIG. 3*a*. A separately formed sole 4 is attached to the bottom of the resilient mat 2.

Figure 3H:
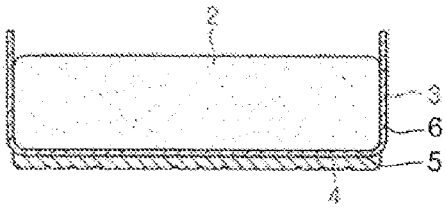

FIGS. 3*f* to 3*h* show the cases in which a sole 4 is separately formed and attached to the bottom portion 5 of the shroud 3. Apart from the separately formed and attached sole 4, FIGS. 3*f* to 3*h* are identical to the embodiments of FIGS. 3*b* to 3*d*.

Figure 4A:
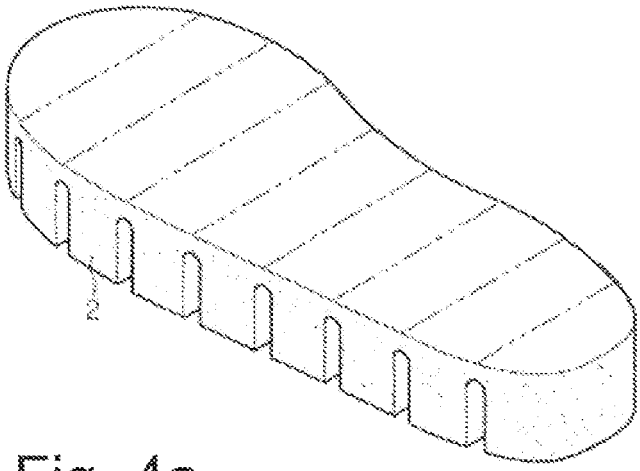
FIGS. 4*a* and 4*b* are perspective views showing preferred embodiments of the cases in which a resilient mat is divided.
Figure 4B:
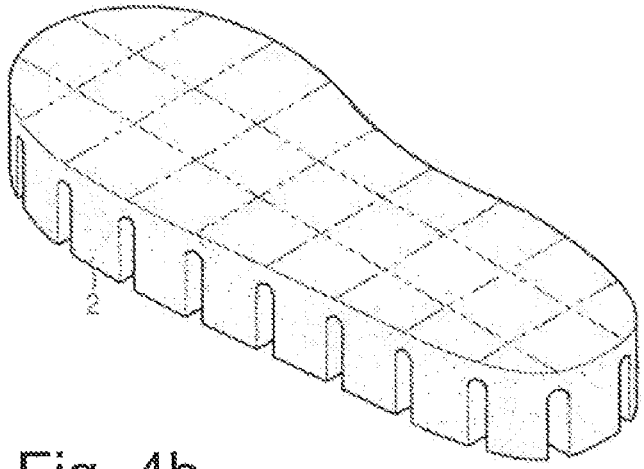
Figure 7A:
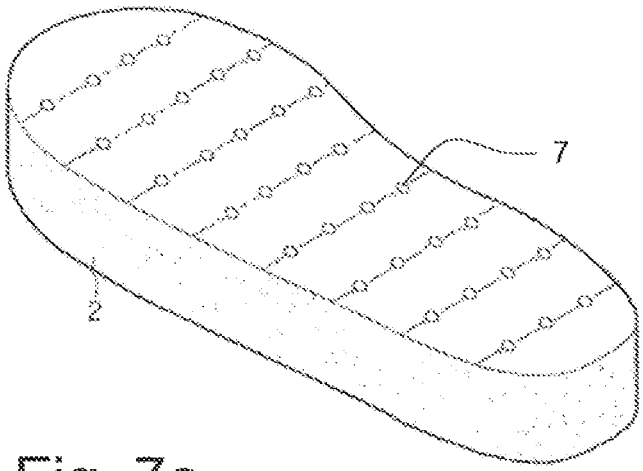
FIGS. 7*a* and 7*b* are views showing a different embodiment of a resilient mat.
Figure 7B:
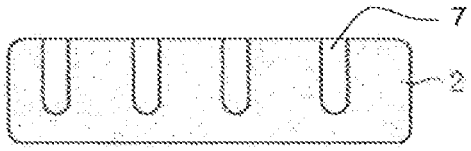

FIGS. 4*a* and 4*b* are perspective views showing the preferred embodiments in which the resilient mat 2 has divisions. In FIG. 7*a*, the resilient mat 2 is divided in different sections from toe to heel the foot. In FIG. 7*b*, the resilient mat 2 is additionally divided into a right, middle and left sections, such that the resilient mat 2 can have the shape of a matrix. Each of the sections can have different material characteristics. The different sections can be separated by groves or can touch each other. However, at least either on top or at the bottom, adjacent sections are fixed to each other.

The shape of a shroud receiving the segmented resilient mat 2 might follow the shape and groves between the sections or can receive the resilient mat regardless of the groves of the resilient mat.

In this case, the shroud or a portion functioning as the shroud can be formed of the same material as the resilient mat 2 or of a different material, thereby strengthening the mechanical friction of the outer surface of the resilient mat 2 depending on manufacturing methods. The resilient mat 2 can be directly attached to the upper foot fixing section or can be used as an inserted material according to the form of the embodiment. Further, a sole (not shown) preventing slide movement of the footwear can be selectively formed on the bottom portion of the shroud. Further, the wearing feeling and the correcting function during walking can be changed depending on the requirements of the wearer by regulating the shape and/or the materials of the divisions of the resilient mat 2.

Figure 5A:
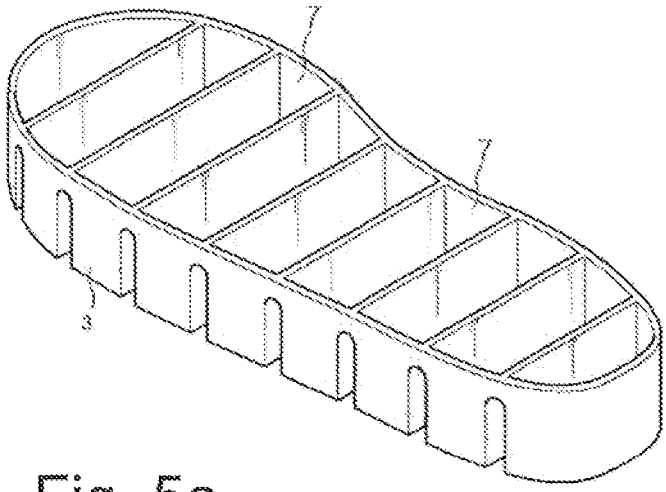
FIGS. 5*a* and 5*b* are views showing the structures of the shroud in the cases in which resilient bodies are inserted into chambers formed by dividing the resilient mat.
Figure 5B:
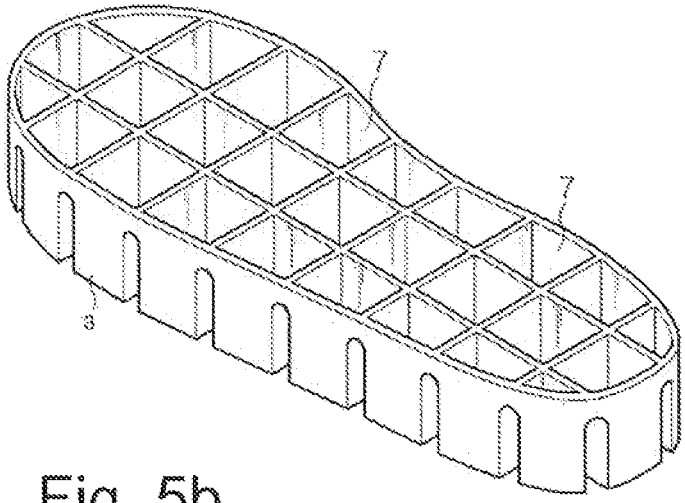

FIGS. 5*a* and 5*b* show the structure of the shroud 3 in which a resilient mat is manufactured by inserting resilient bodies into chambers 7 formed in the divided shroud 3. The shroud 3 forms a plurality of chambers 7 receiving the resilient bodies and the resilient mat 2 is formed by the insertion of the plurality of resilient bodies into the chambers 7. In this case, a shroud cover (not shown) covering opened portions of the resilient mat can selectively be used. In the case of the shroud cover being used, the shroud cover is formed preferably of a soft and ventilating material.

Figure 6A:
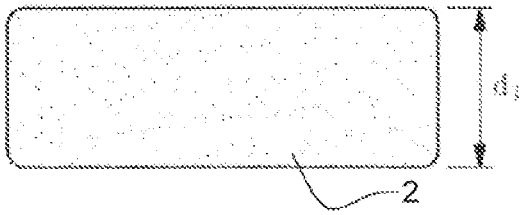
FIGS. 6*a* to 6*c* are views for explaining the compression rate relation when footwear of the present invention is worn.
Figure 6B:
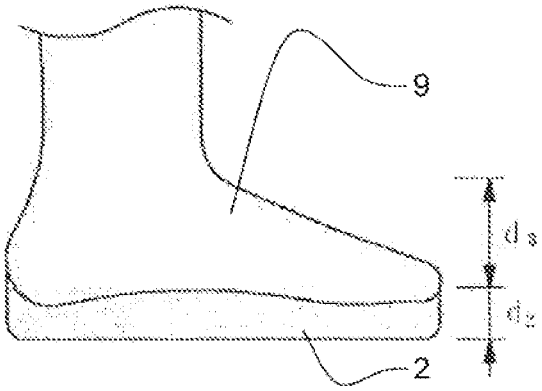
Figure 6C:
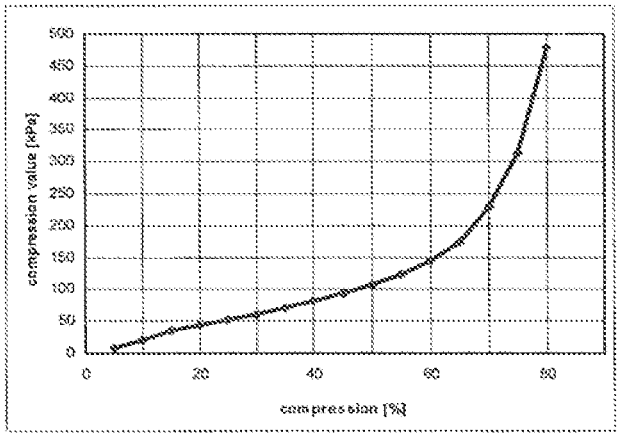

FIGS. 6*a* to 6*c* are views for explaining the compression rate relation in the case in which the footwear is worn.

FIG. 6*a* shows a section across the resilient mat 2 defining the thickness d1 of the resilient mat 2 when no stress or load is applied to the resilient mat 2.

FIG. 6*b* shows a schematically view of the resilient mat 2 with a foot 9 standing on it. The original thickness d1 (see FIG. 6*a*) has been compressed by a difference d3 to a thickness after compression d2. The compression rate can be calculated easy by dividing d3/d1. A typical compression rate is between 50% and 90% when applying the weight of a standard person to the resilient mat 2. However, since not every person is of the same weight and has the same size of feet, the compression strain/stress characteristic of the material of the resilient mat corresponds to the values as given above.

FIG. 6*c* is a graph showing the compression value of the foamed material of the resilient mat 2 as a function of the pressure applied. Thereby the test sample is a square of 70 mm×70 mm having a thickness of 30 mm being compressed according to the test description supplied above. The test sample was cut from the heel area of the resilient mat of a footwear according to this invention.

FIGS. 7*a* and 7*b* show a different embodiment of a resilient mat 2 having holes 7 arranged on its top surface. As can be seen in FIG. 7*b*, the holes 7 are not going completely through the resilient mat 2. The holes are open on the top surface of the resilient mat 2 in order to achieve ventilation during walking when the resilient mat is compressed. This is especially comfortable in hot summer days.

Some of the drawings disclose only the cross-sections for convenience, but the present invention is applied to footwear comprising resilient mats of various shapes.

The footwear according to the present invention has a simple structure and can give a feeling of walking barefoot on a sponge mat or on a lawn like a soft carpet to provide complete comfortableness to the wearer during walking.

Furthermore, the present invention can provide complete comfortableness to the wearer during waking and allows the maximum degree of freedom to the foot.

We claim:

1. Footwear comprising:

an upper foot fixing section for covering and fixing an upper portion of a foot, a foot supporting section attached to the upper foot fixing section for supporting a lower portion of the foot, wherein the foot supporting section comprises a soft resilient mat which can be deformed according to the shape of the foot, the foot supporting section further comprises a shroud covering at least a portion of the outer surface of the resilient mat and fixing the resilient mat, the shroud is an integrally formed part of the resilient mat and/or firmly attached to the resilient mat, the shroud is formed of a latex material or of a polyurethane compound, a rubber compound or a silicone compound, the upper end of the shroud is attached by bonding, gluing, fusing, riveting or sewing to the lower end of the foot fixing section, the shroud comprises a bottom portion integrally formed with a peripheral portion of the shroud, the foot supporting section comprises a sole being integrally formed with the bottom portion of the shroud or being attached to the bottom portion of the shroud, wherein the foamed plastic material has a compression stress value of between 66 kPa and 100 kPa for a compression of 40% and the resilient mat comprising foamed plastic material with a rebound resilience of >30%.

2. Footwear according to claim 1, wherein the foamed material is a polyurethane compound, a rubber compound or a silicone compound.

3. Footwear according to claim 1, wherein the foamed material has an apparent density of between 200 kg/m$^3$ and 360 kg/m$^3$.

4. Footwear according to claim 1, wherein the foamed material has a tear strength of at least 0.9 N/mm.

5. Footwear according to claim 1, wherein the foamed material has a tensile strength of at least 700 kPa.

6. Footwear according to claim 1, wherein the foamed material has an elongation at break of at least 126%.

7. Footwear according to claim 1, wherein the elastic body forming the resilient mat is a closed elastic body which does not discharge air by applying pressure.

8. Footwear according to claim 1, wherein the resilient mat is divided into a plurality of divisions each of which comprises an elastic body.

9. Footwear according to claim 8, wherein the plurality of divisions comprising the resilient bodies have various properties of elasticity.

10. Footwear according to claim 1, wherein the footwear does not comprise a lasting board.

* * * * *